United States Patent [19]

Lambert

[11] Patent Number: 4,815,767

[45] Date of Patent: Mar. 28, 1989

[54] METHOD AND SYSTEM FOR DOCUMENTING AND CONTROLLING THE TAKING OF MEDICATION

[76] Inventor: Patricia Lambert, 356 Rockrimmon Rd., Stamford, Conn. 06903

[21] Appl. No.: 132,351

[22] Filed: Dec. 14, 1987

[51] Int. Cl.[4] ..... B42F 21/06; B42F 1/00; B42D 15/00; G09F 9/00

[52] U.S. Cl. ..... 283/67; 283/900; 283/81; 434/430

[58] Field of Search ..... 283/1 A, 274, 81, 900, 283/67, 69; 434/284, 430, 106; 206/459, 534, 538

[56] References Cited

U.S. PATENT DOCUMENTS

| | | | |
|---|---|---|---|
| 4,039,080 | 8/1977 | Cappuccilli | 283/900 |
| 4,235,459 | 11/1980 | Callahan | 283/81 |
| 4,389,963 | 6/1983 | Pearson | 283/900 |
| 4,476,381 | 10/1984 | Rubin | 283/900 |
| 4,553,670 | 11/1985 | Collens | 283/900 |
| 4,573,580 | 3/1986 | Messer | 283/900 |

FOREIGN PATENT DOCUMENTS

| | | | |
|---|---|---|---|
| 2904582 | 8/1980 | Fed. Rep. of Germany | 283/900 |
| 7239994 | 4/1975 | France | 283/900 |

*Primary Examiner*—Frank T. Yost
*Assistant Examiner*—Paul M. Heyrana, Sr.
*Attorney, Agent, or Firm*—Parmelee, Bollinger & Bramblett

[57] ABSTRACT

A chart is divided into sections representing different times of day and days of the week for providing a space to indicate and document when medication should be taken as well as to indicate if the medication has been taken. A plurality of sets of different distinctively shaped and colored stickers are provided which are clearly visibly distinguishable one set from the other sets. A selected set of stickers is chosen for each medication which is to be taken and the sticker from that set is affixed on the chart on the appropriate day and time as prescribed by the user's doctor. At the same time, the same shaped sticker from that selected set is affixed on the prescription container. By matching the shape of the sticker on the bottle with the shape of the sticker on the chart, the medication to be taken is clearly identified at specific times of the day, and when it is taken a mark is placed in the section of the chart next to the sticker indicating the time and day on which it is taken to provide a permanent record of what medication is taken as well as when. By using a different set of stickers of each type of medication a system is provided for reminding the patient of the type of medication which is to be taken, when it is to be taken as well as providing a permanent record when it is taken.

7 Claims, 2 Drawing Sheets

METHOD AND SYSTEM FOR DOCUMENTING AND CONTROLLING THE TAKING OF MEDICATION

BACKGROUND OF THE INVENTION

This invention relates to a method and system for reminding, controlling and documenting the taking of prescribed medication which is particularly useful for the elderly as well as the physically and/or mentally impaired patient.

Medical advances and a variety of factors are leading to ever increasing life expectancy. However, increasing age and larger elderly populations sometimes tax medical facilities resulting in limiting the medical stay in such facilities. The result is that many people are discharged from full care facilities before they are completely able to take care of themselves. Some of this premature discharge may be attributed to the diagnostic-related-groups (DRG) system. Many such patients as well as other physically or mentally impaired patients are required to take medication and in many cases, multiple medications in order to survive. Without help, the reading of labels and the taking of medication becomes a particular problem for the elderly and/or physically or mentally impaired patients. In many instances, life itself may depend on the proper taking and regulation of prescribed medication. With patients taking as many as three, four or more prescriptions per day, it is a difficult task even for a well adjusted patient to take his medication at the proper times and to insure that the medication which has been prescribed has been taken without making errors with respect to the type or amount of medication which has been prescribed.

SUMMARY

Accordingly, it is an object of this invention to provide a new method and system for aiding, controlling and monitoring the taking of prescribed medication.

Still another object of this invention is to provide a novel method and system which will provide an aid to the mentally and/or physically impaired or aged to taking medication which is simple, easy to follow and prevents error in the taking of prescribed medication.

In carrying out this invention in one illustrative embodiment thereof, the method of reminding, controlling and documenting the taking of prescribed medication is provided comprising the steps of dividing a chart into sections representing different days of the week and selected times for each day for providing space to indicate and document when medication should be taken and space to indicate if the medication has been taken at that time. A plurality of sets of different distinctively shaped and colored stickers are provided which are clearly visibly distinguishable one from each of the other sets. A sticker from a selected set of stickers of the user's choice are affixed on the chart on the appropriate day and time as prescribed by the user's doctor, and at the time a sticker from the same set is affixed to the prescription container. Location of the medication to be taken is made by matching the shape of the sticker on the bottle with the shape of the sticker on the chart and then a mark or indication is placed in a section on the chart next to the sticker to provide a permanent record of what medication is taken and when such medication has been taken.

Different sets of stickers are used for different prescriptions, one set of stickers being used for each prescription. A packet of charts and stickers are provided which are designed to last for a given period of time.

BRIEF DESCRIPTION OF THE DRAWINGS

The invention, together with further objects, features, advantages and aspects thereof, will be more clearly understood from the following description taken in connection with the accompanying drawings in which like reference numerals are used on like elements throughout the various views.

DESCRIPTION OF THE PREFERRED EMBODIMENTS

Figure 1:
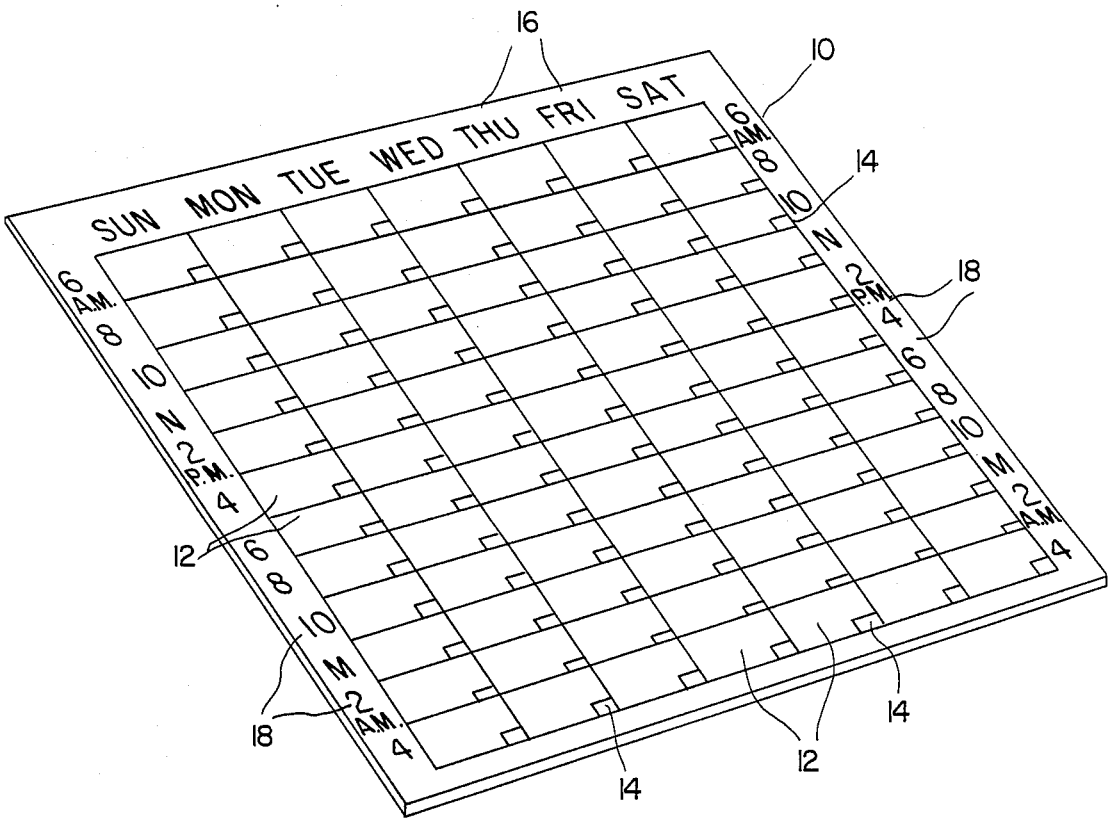
FIG. 1 is a perspective view of a time/day chart divided into sections representing the seven days of the week and selected times for each day.

Referring now to FIG. 1, a documentation chart 10 is divided into sections 12 each having a small box 14 therein. Each section 12 represents different days of the week 16, as well as different times of the day 18. As illustrated in FIG. 1, the days of the week are illustrated horizontally while the times of day are illustrated vertically which is the preferred form: however, it will be appreciated that the designations could be reversed with the times of day appearing horizontally while the days could be represented vertically. The days of the week are fixed and cover each day of the week while the times of day represent selected times represented in FIG. 1 as twelve two-hour intervals which are shown as even numbered hours. Any breakdown such as odd numbered hours, or for that matter all 24 hours of the day could be represented. The selected even numbered hours are believed adequate for covering prescriptions which may be taken 3 or 4 times a day. The pattern of even numbers is believed most easily recognizable and capable of being followed by the physically and/or mentally impaired.

Figure 2:
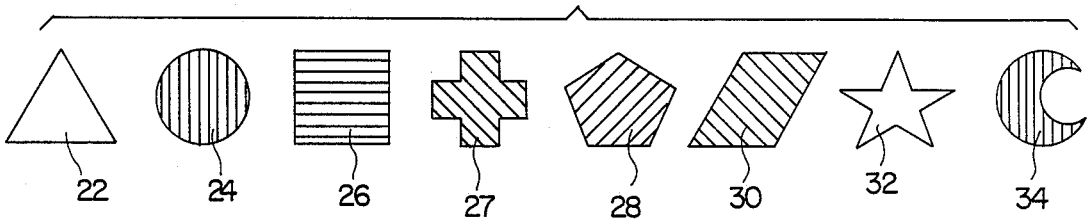
FIG. 2 is a diagram illustrating a plurality of visibly distinct geometrically shaped stickers which are used in the system and method of this invention.

FIG. 2 shows a plurality of geometric stickers referred to generally with the reference numeral 20 which includes a triangle 22, a circle 24, a square 26, a cross 27, a pentagon 28, a parallelogram 30, a five pointed star 32 and a crescent 34. The stickers 20 also have distinctive differing colors, which in addition to their shape will help those who are not color blind in further recognition in distinguishing the stickers 20 one from the other. Although it will be appreciated that different types and shapes of stickers may be utilized, for example, trees, animals, etc., the geometric shapes displayed in FIG. 2 are preferable due to their easy recognition and the ability of/a physically and/or mentally impaired person to be able to clearly distinguish one from the other. The geometric shapes lend themselves to recognition by the visually impaired because the different shapes can be distinguished by touch. In addition, for the blind, the stickers may include a Braille outline or or include Braille instructional inscriptions. The construction of the stickers other than the shape and the color are conventional with a back surface which is suitable for adhering the stickers 20 to the face of the chart 10.

The system of the present invention will include a complete package of charts 10 and a plurality of sets of stickers 20 having the different geometric shapes 22, 24, 26, 27, 28, 30, 32 and 34 as illustrated. Enough charts 10 and stickers 20 are provided to last a given period of time; for example, three to six months.

The chart 10 is placed on a wall or table in a convenient location so that it is always accessible, available and visible to the user. The location of the chart will be one of convenience and placed in suitable locations where the medication to be taken is kept. In using the chart, a sticker of the user's choice is affixed to the appropriate time and day at which the medication to be taken as prescribed by the user's physician. Assuming, for example, a prescription is to be taken twice a day at 10 AM and 6 PM, fourteen of the same stickers from a given set of stickers will be required to be affixed on the chart for a one week period. Accordingly, a set of the stickers for example, triangles 22, will have fourteen triangles 22 affixed to sections 12 on the chart 10 for the whole week covering the times of 10 AM and 6 PM.

Figure 3:
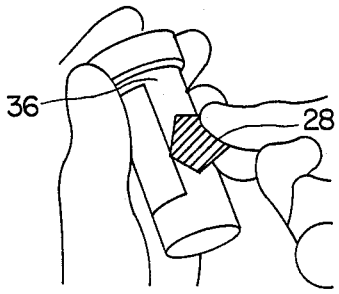
FIG. 3 illustrates affixing one of the stickers illustrated in FIG. 2 to a medication container in accordance with one aspect of the present invention.
Figure 4:
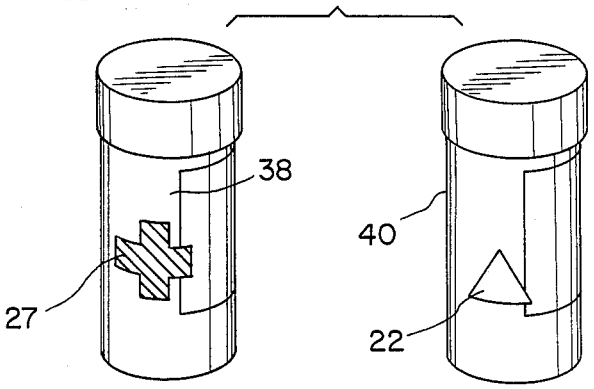
FIG. 4 illustrates two medical containers to which different geometric stickers from FIG. 2 have been attached to represent different types of medication.

The next step is to use the same shape sticker 20 and place that sticker on the side of the prescription container 36 as illustrated in FIG. 3. In FIG. 3, a pentagon sticker 28 has been illustrated being affixed to a prescription bottle 36. In affixing the sticker 20 to the container 36 care must be taken not to cover the label on the bottle. If multiple prescriptions requiring multiple medications are to be taken in any given day, a different shaped sticker 20 is used for each medicaiton. As is illustrated in FIG. 2 at least 8 different shapes are included with the system which includes the charts 10. When the different shaped stickers representing different medications are all in place on the chart 10, the chart will show exactly when to take each medication. Since the same sticker has been affixed to the medication containers, a system is provided for clearly indicating the type of medication which is to be taken at a given time of day. In FIG. 4 medical containers 38 and 40 have crosses 27 and triangles 22, respectively, affixed thereto representing different medications. Thus, as will be seen in FIGS. 3 and 4, three different medical containers 36, 38 and 40, have three different stickers 28, 27, and 22, respectively, affixed thereto representing three different prescribed medications.

Figure 5:
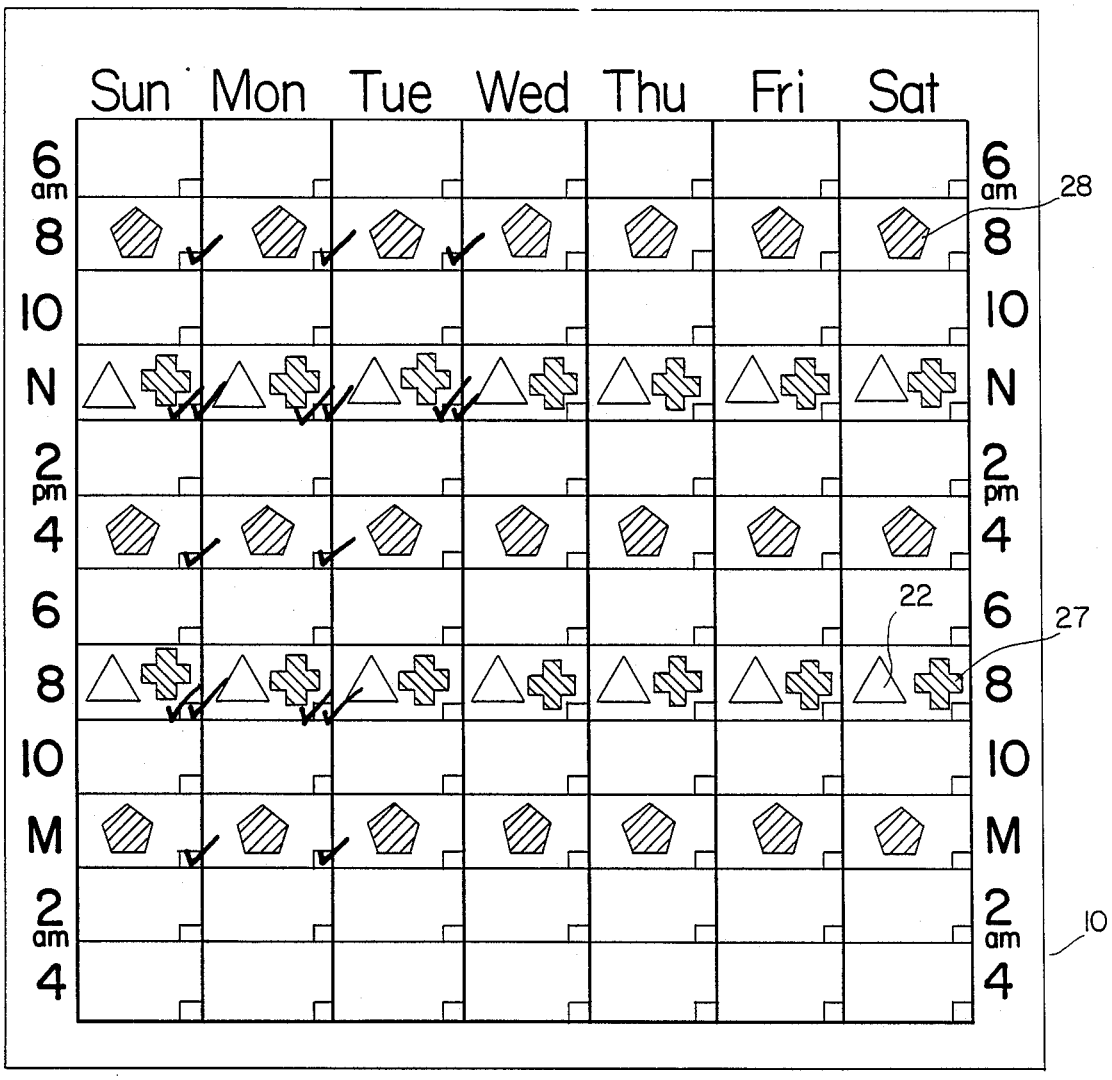
FIG. 5 illustrates the manner in which the chart of FIG. 1 is used in which different stickers representing different prescriptions are affixed to the chart in accordance with the prescriptions from the user's doctor and marks are made to indicate that the prescribed drugs have been taken.

Simply as an illustrative example, FIG. 5 illustrates a chart 10 having three different shaped and colored stickers 22, 27 and 28 affixed thereto. The pentagon stickers 28 indicate that the prescribed medication is to be taken three times a day at 8 AM, 4 PM, and midnight. The triangular sticker 22 and cross sticker 27 are two additional medications which have been prescribed to be taken twice a day at noon and 8 PM. Accordingly, when the stickers 20 are in place, the chart 10 will show exactly when to take each medication and by finding the matching shape from the bottle shown in FIGS. 3 and 4 to the chart, errors will be avoided. Then when the medication is taken, a check or "x" or any other suitable mark is placed in the appropriate small box 14 next to each sticker or group of stickers if more than one medication is taken. FIG. 5 illustrates that complete medication has been taken on Sunday and Monday and that the pentagon shaped medication has been taken at 8 AM on Tuesday while both the triangular and cross medications have been taken at noon. Accordingly, the chart shows very clearly what has been taken and when, and when the next medication and the type of that medication is due. The charts may be kept for a reference to provide clear documentation of the type and amount of medication taken. Such charts may e useful to the prescribing physician.

Accordingly, a system and method are provided for aiding, controlling and accurately documenting the amount and time prescribed medication is to be taken and when it is taken. The shapes and the colors of the stickers are distinctive, are easy to handle, and permit even the mentally and physically impaired as well as the elderly to handle the system. Even if aid is required for affixing the stickers, a complete chart may be filled out for a week and the matching stickers placed on the medication so that all the patient has to do is simply match the medication bottle sticker to the sticker on the chart and take the medication and so indicate by making a mark on the chart that the medication has actually been taken. The method and system are simple, easy to understand and easy to execute.

Since other changes and modifications varied to fit particular operating requirements and environments will be apparent to those skilled in the art, the invention is not considered limited to the examples chosen for purposes of illustration, and includes all changes and modifications which do not constitute a departure from the true spirit and scope of this invention as claimed in the following claims and equivalents thereto.

What is claimed is:

1. A system for controlling and documenting the taking of prescribed medication by the user from different medicine containers comprising:

a documentation chart divided into sections representing days of the week and selected times in a given day for providing a space to indicate and document when medication is due to be taken and when said medication is actually taken, a plurality of sets of different distinctively shaped and colored stickers which are clearly visibly distinguishable one set from each of the other sets, at least a first of said plurality of sets of stickers adapted to be affixed to said chart at the approximate times and days which identify one type of medication which has been prescribed for the use and also are to be affixed to the container housing the prescribed medication whereby the container housing the prescribed medication and the times for taking the medication on the chart have the same type of sticker from the same set of stickers so the patient by looking at the chart which shows exactly when the medication is to be taken simply matches the shape of the stickers on the chart with the shape of the stickers on the container before taking medication thereby preventing errors in the taking of the medication, and a mark is placed in the section containing the sticker of the prescribed medication when it is taken to provide a clear and accurate permanent record of the medication taken as well as the time at which such medication is taken.

2. The system as claimed in claim 1 wherein:

at least a second of said plurality sets of stickers are to be affixed to said chart and container representing another type of prescribed medication so that said one type of medication and said other type of medication is each distinguished and identified to prevent errors in taking and recording the taking of different types of medication.

3. The system as claimed in claim 1 wherein each of said sections on said chart includes a box for providing a separate marking space in each of said sections.

4. The system as claimed in claim 1 wherein said stickers have distinctive geometric shapes selected from a group comprising triangles, circles, squares, crosses, pentagons, parallelograms, stars and crescents.

5. A method for reminding, controlling and documenting the taking of prescribed medication comprising the steps of:

dividing a documentation chart into sections representing different days of a week and selected times for each day for providing space and to indicate and document when medication should be taken and space to indicate if the medication has been taken at that time, providing a plurality of sets of different distinctively shaped and colored stickers which are clearly visibly distinguishable one from each of the other sets, affixing a sticker from a selected set of stickers of the user's choice on the chart on the appropriate day and time as prescribed by the user's doctor, taking the same shaped sticker from said selected set of stickers and affixing it on the prescription container taking care not to cover the label on the container, locating the medication to be taken by matching the shape of the sticker on the bottle with the shape of sticker on the chart, placing a mark in the section on the chart next to the sticker in that section to provide a permanent record for what and how much medication is taken and when such medication is taken.

6. The method as set forth in claim 4, wherein:

the step of affixing a sticker to a section on the chart and a container housing medication is repeated for each different medication using a different set of stickers.

7. The method as claimed in claim 4 including the step of providing a box in each section on which marks are placed to indicate the time and day prescribed medication is taken.

* * * * *